US006919785B2

(12) United States Patent
Douville et al.

(10) Patent No.: US 6,919,785 B2
(45) Date of Patent: Jul. 19, 2005

(54) PRESSURE SENSITIVE TRIP MECHANISM FOR A ROTARY BREAKER

(75) Inventors: Gary Douville, East Hartford, CT (US); Palani Doma, Bristol, CT (US)

(73) Assignee: General Electric Company, Schenectady, NY (US)

( * ) Notice: Subject to any disclaimer, the term of this patent is extended or adjusted under 35 U.S.C. 154(b) by 25 days.

(21) Appl. No.: 10/248,912

(22) Filed: Feb. 28, 2003

(65) Prior Publication Data

US 2003/0112104 A1 Jun. 19, 2003

Related U.S. Application Data

(63) Continuation of application No. 09/682,319, filed on Aug. 20, 2001, now Pat. No. 6,542,057, which is a continuation of application No. 09/571,810, filed on May 16, 2000, now Pat. No. 6,373,357.

(51) Int. Cl.[7] ..... H01H 9/00
(52) U.S. Cl. ..... 335/172; 335/202
(58) Field of Search ..... 335/8–10, 16, 335/165–176, 201–202; 218/154

(56) References Cited

U.S. PATENT DOCUMENTS

| | | | | |
|---|---|---|---|---|
| 2,340,682 A | | 2/1944 | Powell | |
| 2,719,203 A | | 9/1955 | Getzheiser, et al. | |
| 2,937,254 A | | 5/1960 | Ericson | |
| 3,158,717 A | | 11/1964 | Jencks, et al. | |
| 3,162,739 A | | 12/1964 | Klein, et al | |
| 3,197,582 A | | 7/1965 | Norden | |
| 3,307,002 A | | 2/1967 | Cooper | |
| 3,517,356 A | | 6/1970 | Hanafusa | |
| 3,624,329 A | | 11/1971 | Fischer et al. | 200/153 |
| 3,631,369 A | * | 12/1971 | Menocal | 337/110 |
| 3,646,292 A | | 2/1972 | Barkan et al. | 200/82 |
| 3,803,455 A | | 4/1974 | Willard | |
| 3,883,781 A | | 5/1975 | Cotton | |
| 4,129,762 A | | 12/1978 | Bruchet | |
| 4,144,513 A | | 3/1979 | Shafer et al. | |
| 4,158,119 A | | 6/1979 | Krakik | |
| 4,165,453 A | | 8/1979 | Hennemann | |
| 4,166,988 A | | 9/1979 | Ciarcia et al. | |
| 4,220,934 A | | 9/1980 | Wafer et al. | |
| 4,255,732 A | | 3/1981 | Wafer et al. | |
| 4,259,651 A | | 3/1981 | Yamat | |
| 4,263,492 A | | 4/1981 | Maier et al. | |
| 4,276,527 A | | 6/1981 | Gerbert-Gaillard et al. | |
| 4,297,663 A | | 10/1981 | Seymour et al. | |
| 4,301,342 A | | 11/1981 | Castonguay et al. | |
| 4,360,852 A | | 11/1982 | Gilmore | |
| 4,368,444 A | | 1/1983 | Preuss et al. | |
| 4,375,021 A | | 2/1983 | Pardini et al. | |

(Continued)

FOREIGN PATENT DOCUMENTS

| | | | |
|---|---|---|---|
| BE | 819 008 A | 12/1974 | H01H/083/14 |
| DE | 1 227 978 | 11/1966 | |
| DE | 30 47 360 | 6/1982 | H01H/85/20 |

(Continued)

*Primary Examiner*—Lincoln Donovan
(74) *Attorney, Agent, or Firm*—Cantor Colburn LLP

(57) ABSTRACT

A pressure sensitive trip mechanism for actuating a circuit breaker operating mechanism to trip a circuit breaker includes a trip lever and a trip bar. The trip lever is rotatable about a first pivot. The trip bar is positioned proximate the trip lever. The trip bar is arranged to rotate about a second pivot in response to a predetermined level of pressurized gas created by separation of the pair of electrical contacts, thereby urging the trip lever to unlatch the circuit breaker operating mechanism. The pressure sensitive trip mechanism provides for very fast tripping of the circuit breaker in the event of a short circuit condition or an overcurrent fault condition within any one on the circuit breaker poles. In a multi-pole circuit breaker, the present invention provides for protection against single-phasing.

8 Claims, 6 Drawing Sheets

U.S. PATENT DOCUMENTS 4,375,022 A 2/1983 Daussin et al.
4,376,270 A 3/1983 Staffen
4,383,146 A 5/1983 Bur
4,392,036 A 7/1983 Troebel et al.
4,393,283 A 7/1983 Masuda
4,401,872 A 8/1983 Boichot-Castagne et al.
4,409,573 A 10/1983 Di Marco et al.
4,435,690 A 3/1984 Link et al.
4,467,297 A 8/1984 Boichot-Castagne et al.
4,468,645 A 8/1984 Gerbert-Gaillard et al.
4,470,027 A 9/1984 Link et al.
4,479,143 A 10/1984 Watanabe et al.
4,488,133 A 12/1984 McClellan et al.
4,492,941 A 1/1985 Nagel
4,541,032 A 9/1985 Schwab
4,546,224 A 10/1985 Mostosi
4,550,360 A 10/1985 Dougherty
4,562,419 A 12/1985 Preuss et al.
4,589,052 A 5/1986 Dougherty
4,595,812 A 6/1986 Tamaru et al.
4,611,187 A 9/1986 Banfi
4,612,430 A 9/1986 Sloan et al.
4,616,198 A 10/1986 Pardini
4,622,444 A 11/1986 Kandatsu et al.
4,631,625 A 12/1986 Alexander et al.
4,642,431 A 2/1987 Tedesco, et al.
4,644,438 A 2/1987 Puccinelli et al.
4,649,247 A 3/1987 Preuss et al.
4,658,322 A 4/1987 Rivera
4,672,501 A 6/1987 Bilac et al.
4,675,481 A 6/1987 Markowski et al.
4,682,264 A 7/1987 Demeyer
4,689,712 A 8/1987 Demeyer
4,694,373 A 9/1987 Demeyer
4,710,845 A 12/1987 Demeyer
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachter et al.
4,831,221 A 5/1989 Yu et al.
4,870,531 A 9/1989 Danek
4,883,931 A 11/1989 Batteux et al. ..... 218/46
4,884,047 A 11/1989 Baginski et al.
4,884,164 A 11/1989 Dziura et al.
4,900,882 A 2/1990 Bernard et al.
4,910,485 A 3/1990 Bolongeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,935,590 A 6/1990 Malkin et al. ..... 218/57
4,937,706 A 6/1990 Schueller et al.
4,939,492 A 7/1990 Raso et al.
4,943,691 A 7/1990 Mertz et al. ..... 218/117
4,943,888 A 7/1990 Jacob et al.
4,950,855 A 8/1990 Bolongeat-Mobleu et al. ..... 218/66
4,951,019 A 8/1990 Gula
4,952,897 A 8/1990 Barnel et al.
4,958,135 A 9/1990 Baginski et al.
4,965,543 A 10/1990 Batteux
4,983,788 A 1/1991 Pardini
5,001,313 A 3/1991 Leclercq et al.
5,004,878 A 4/1991 Seymour et al.
5,029,301 A 7/1991 Nebon et al.
5,057,655 A 10/1991 Kersusan et al. ..... 218/76
5,103,198 A * 4/1992 Morel et al. ..... 335/6
5,187,339 A 2/1993 Lissandrin ..... 218/84
5,281,776 A 1/1994 Morel et al.
5,296,660 A 3/1994 Morel et al.
5,296,664 A 3/1994 Crookston et al.
5,298,874 A * 3/1994 Morel et al. ..... 335/8
5,300,907 A 4/1994 Nereau et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu et al.
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,373,130 A 12/1994 Barrault et al. ..... 218/30
5,379,013 A 1/1995 Coudert
5,424,701 A 6/1995 Castonguay et al.
5,451,729 A 6/1995 Onderka et al.
5,438,176 A 8/1995 Bonnardel et al.
5,440,088 A 8/1995 Coudert et al.
5,449,871 A 9/1995 Batteux et al.
5,450,048 A 9/1995 Leger et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.
5,493,083 A 2/1996 Olivier
5,504,284 A 4/1996 Lazareth et al.
5,504,290 A 4/1996 Baginski et al.
5,510,761 A 4/1996 Boder et al.
5,512,720 A 4/1996 Coudert et al.
5,515,018 A 5/1996 DiMarco et al.
5,519,561 A 5/1996 Mrenna et al.
5,534,674 A 7/1996 Steffens
5,534,832 A 7/1996 Duchemin et al.
5,534,835 A 7/1996 McColloch et al.
5,534,840 A 7/1996 Cuingnet
5,543,595 A 8/1996 Mader et al.
5,552,755 A 9/1996 Fello et al.
5,581,219 A 12/1996 Nozawa et al.
5,604,656 A 2/1997 Derrick et al.
5,608,367 A 3/1997 Zoller et al.
5,731,561 A 3/1998 Manthe et al. ..... 218/35
5,784,233 A 7/1998 Bastard et al. ..... 361/36
6,281,458 B1 8/2001 Castonguay et al. ..... 218/22
6,373,357 B1 4/2002 Douville et al. ..... 335/172

FOREIGN PATENT DOCUMENTS

DE 38 02 184 A1 8/1989 ..... H01H/3/46
DE 38 43 277 A1 6/1990 ..... H02H/3/08
DE 44 19 240 A1 1/1995 ..... H01H/9/10
EP 0 061 092 A1 3/1982 ..... G03G/5/14
EP 0 117 094 A1 8/1984 ..... H01H/71/10
EP 0 064 906 B1 9/1984 ..... H01H/71/74
EP 0 076 719 B1 4/1985 ..... H01H/71/74
EP 0 140 761 A2 5/1985 ..... H01H/71/52
EP 0 066 0486 B1 10/1985 ..... H01H/71/52
EP 0 196 241 A1 10/1986 ..... H01H/71/00
EP 0 224 396 6/1987 ..... H01H/71/52
EP 0 235 479 A1 9/1987 ..... H02H/3/04
EP 0 239 460 A1 9/1987 ..... H01H/33/24
EP 0 258 090 A1 3/1988 ..... H02H/7/22
EP 0 264 313 A1 4/1988 ..... H01H/83/04

| | | | |
|---|---|---|---|
| EP | 0 264 314 A1 | 4/1988 | H01H/83/00 |
| EP | 0 283 189 A2 | 9/1988 | H02B/13/02 |
| EP | 0 283 358 A1 | 9/1988 | H02H/3/10 |
| EP | 0 291 374 A1 | 11/1988 | H01H/83/20 |
| EP | 0 295 155 A1 | 12/1988 | H01H/83/20 |
| EP | 0 295 158 A1 | 12/1988 | H01H/71/52 |
| EP | 0 309 923 A2 | 4/1989 | H01H/71/68 |
| EP | 0 313 106 A2 | 4/1989 | H02B/13/02 |
| EP | 0 313 422 A1 | 4/1989 | H02H/1/00 |
| EP | 0 314 540 A1 | 5/1989 | H01H/1/20 |
| EP | 0 331 586 A1 | 9/1989 | H01H/83/20 |
| EP | 0 337 900 A1 | 10/1989 | H01H/71/32 |
| EP | 0 342 133 A1 | 11/1989 | H01H/71/50 |
| EP | 0 367 690 A1 | 5/1990 | H02H/3/04 |
| EP | 0 371 887 A1 | 6/1990 | H01H/71/10 |
| EP | 0 375 568 A1 | 6/1990 | H01H/71/02 |
| EP | 0 394 144 A1 | 10/1990 | H01H/71/46 |
| EP | 0 394 922 A1 | 10/1990 | H01H/1/20 |
| EP | 0 407 310 A1 | 1/1991 | H02H/3/347 |
| EP | 0 452 230 A1 | 10/1991 | H01H/71/50 |
| EP | 0 555 158 B1 | 8/1993 | H01H/71/52 |
| EP | 0 567 416 B1 | 10/1993 | H01H/9/26 |
| EP | 0 595 730 A1 | 5/1994 | H01H/71/08 |
| EP | 0 619 591 A1 | 10/1994 | H01H/71/40 |
| EP | 0 665 569 A1 | 8/1995 | H01H/83/22 |
| EP | 0 700 140 A1 | 3/1996 | H02H/3/33 |
| FR | 2 410 353 | 6/1979 | H01H/51/24 |
| FR | 2 512 582 | 3/1983 | H01H/9/20 |
| FR | 2 553 943 | 4/1985 | H02H/3/33 |
| FR | 2 592 998 | 7/1987 | H02H/3/10 |
| FR | 2 697 670 | 5/1994 | H01H/51/27 |
| FR | 2 699 324 | 6/1994 | H01H/71/10 |
| FR | 2 714 771 | 7/1995 | H02H/7/045 |
| GB | 2 233 155 | 1/1991 | H01H/77/10 |
| RU | 1 227 978 A1 | 4/1986 | G01N/3/30 |
| WO | WO 92/00598 | 1/1992 | H01H/1/50 |
| WO | WO 92/05649 | 4/1992 | H04M/1/00 |
| WO | WO 94/00901 | 1/1994 | H02H/5/04 |

* cited by examiner

2/6

36
36
14
35
35
12
26
20
118
32
38
28
22
116
22
30
22
34
18

PRESSURE SENSITIVE TRIP MECHANISM FOR A ROTARY BREAKER

CROSS REFERENCE TO RELATED APPLICATIONS

This application is a continuation of U.S. patent application 09/682,319, filed 20 Aug. 2001, now U.S. Pat. No. 6,542,057, which is a continuation of U.S. patent application Ser. No. 09/571,810, filed 16 May 2000 and allowed as U.S. Pat. No. 6,373,357, both of which are incorporated by reference herein in their entirety.

BACKGROUND OF THE INVENTION

The present invention relates generally to circuit breakers and more particularly to a circuit breaker employing a pressure sensitive trip mechanism for instantaneously unlatching the circuit breaker operating mechanism in response to an overcurrent or short circuit condition.

Circuit breakers are one of a variety of overcurrent protective devices used for circuit protection and isolation. The basic function of a circuit breaker is to provide electrical system protection whenever an electrical abnormality occurs in any part of the system. In a rotary contact circuit breaker, current enters the system from a power source. The current passes through a line strap to a fixed contact fixed on the strap and then to a moveable contact. The moveable contact is fixedly attached to an arm, and the arm is mounted to a rotor that in turn is rotatably mounted in a cassette. As long as the fixed contact is in physical contact with the moveable contact, the current passes from the fixed contact to the moveable contact and out of the circuit breaker to downstream electrical devices.

In the event of an extremely high overcurrent condition (e.g. a short circuit), electromagnetic forces are generated between the fixed and moveable contacts. These electromagnetic forces repel the movable contact away from the fixed contact. Because the moveable contact is fixedly attached to a rotating arm, the arm pivots and physically separates the fixed contact from the moveable contact.

For a given model of circuit breaker, various types of trip units may be used. For example, mounted within a circuit breaker housing, a mechanical trip unit (e.g. thermal-magnetic or magnetic) can be employed. Alternatively, an electronic trip unit can also be employed that utilizes a current transformer. In order to trip the circuit breaker, the selected trip unit must activate a circuit breaker operating mechanism. Once activated, the circuit breaker operating mechanism separates a pair of main contacts to stop the flow of current in the protected circuit. Conventional trip units act directly upon the circuit breaker operating mechanism to activate the circuit breaker operating mechanism.

In all circuit breakers, the separation of the breaker contacts due to a short circuit causes an electrical arc to form between the separating contacts. The arc causes the formation of relatively high-pressure gases as well as ionization of air molecules within the circuit breaker. Exhaust ports are conventionally employed to vent such gasses in a rotary contact circuit breaker; each phase (pole) employs two pairs of contacts, two contacts of which rotate about a common axis generally perpendicular to the current path from the line side to the load side of the circuit breaker. Each contact set in such an arrangement requires an exhaust port to expel gasses.

During an overcurrent or short circuit condition, it is desirable to trip the circuit breaker as quickly as possible in order to minimize the energy that the circuit breaker must absorb. For example, a very high level of arcing energy can develop when interrupting short circuits. Relatively severe, high level, and long lasting arcing can lead to excessive wear to the contacts as well as the arc chutes. Furthermore, if the circuit breaker can trip very quickly, higher interruption ratings can be achieved. With higher interruption ratings, overall circuit performance is improved. At the same time, any tripping system must also ensure protection for the circuit breaker and the system in the event of a single-phase condition, e.g. only one phase becomes overloaded. In a multi-phase system, a single-phase condition exists when one pole experiences a fault thereby blowing open and locking open the contacts of that pole. The remaining poles do not experience the fault and therefore their respective contacts remain closed. A single-phase condition is never desirable in a multi-phase system.

Therefore, it is desirable to provide a circuit breaker tripping mechanism that will trip a circuit breaker very quickly while ensuring protection of the circuit breaker and the electrical system should a single-phase condition occur.

SUMMARY OF THE INVENTION

In the present invention, a pressure sensitive trip mechanism for actuating a circuit breaker operating mechanism to trip a circuit breaker includes a trip lever and a trip bar. The trip lever is rotatable about a pivot and includes a first free end and a second free end. The second free end is configured for interacting with the latching mechanism. The trip bar is positioned proximate said first free end of the trip lever. The trip bar is arranged to rotate about a pivot in response to a predetermined level of pressurized gas created by separation of the pair of electrical contacts, thereby urging the second free end of the trip lever to unlatch the circuit breaker operating mechanism.

In a further exemplary embodiment of the present invention, a trip finger is employed with the pressure sensitive trip mechanism to mechanically trip the circuit breaker. In this embodiment of the present invention, at least one trip finger protrudes radially outward from the trip bar. The trip finger is configured for mechanically interacting with the movable contact arm of the circuit breaker thereby urging the trip bar to rotate about the pivot.

DETAILED DESCRIPTION OF THE INVENTION

Figure 1:
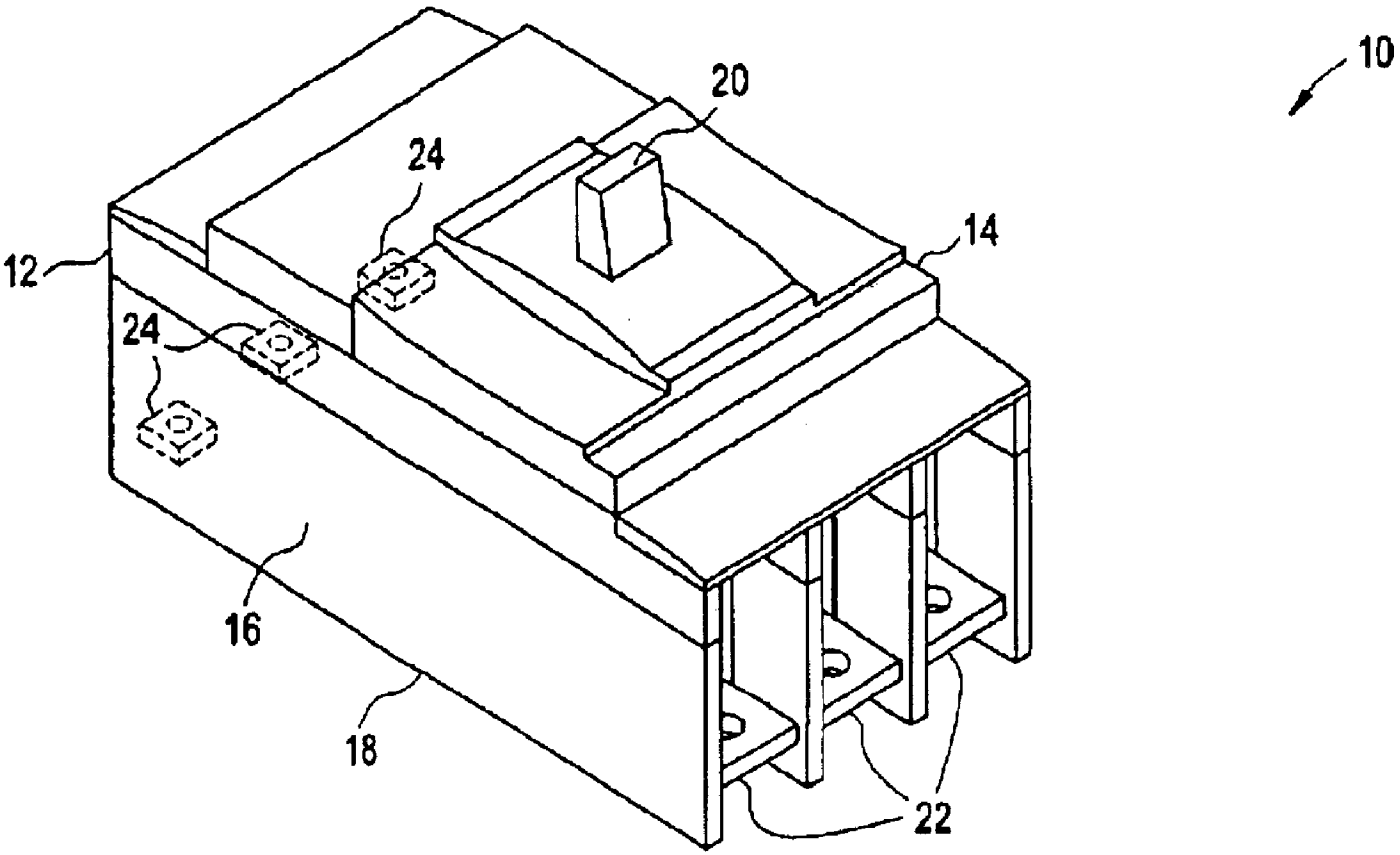
FIG. 1 is a perspective view of a circuit breaker.

Referring to FIG. 1, an embodiment of a molded case circuit breaker 10 is generally shown. Circuit breakers of this type generally an insulated case 16 having a cover 14 attached to a mid-cover 12 coupled to a base 18. A handle 20 extending through cover 14 gives the operator the ability to turn the circuit breaker 10 "on" to energize a protected circuit (shown on FIG. 3), turn the circuit breaker "off" to disconnect the protected circuit (not shown), or "reset" the circuit breaker after a fault (not shown). A plurality of line-side contact and load-side straps 22, 24 also extend through the case 16 for connecting the circuit breaker 10 to the line and load conductors of the protected circuit. The circuit breaker 10 in FIG. 1 shows a typical three phase configuration, however, the present invention is not limited to this configuration but may be applied to other configurations, such as one, two or four phase circuit breakers.

Figure 2:
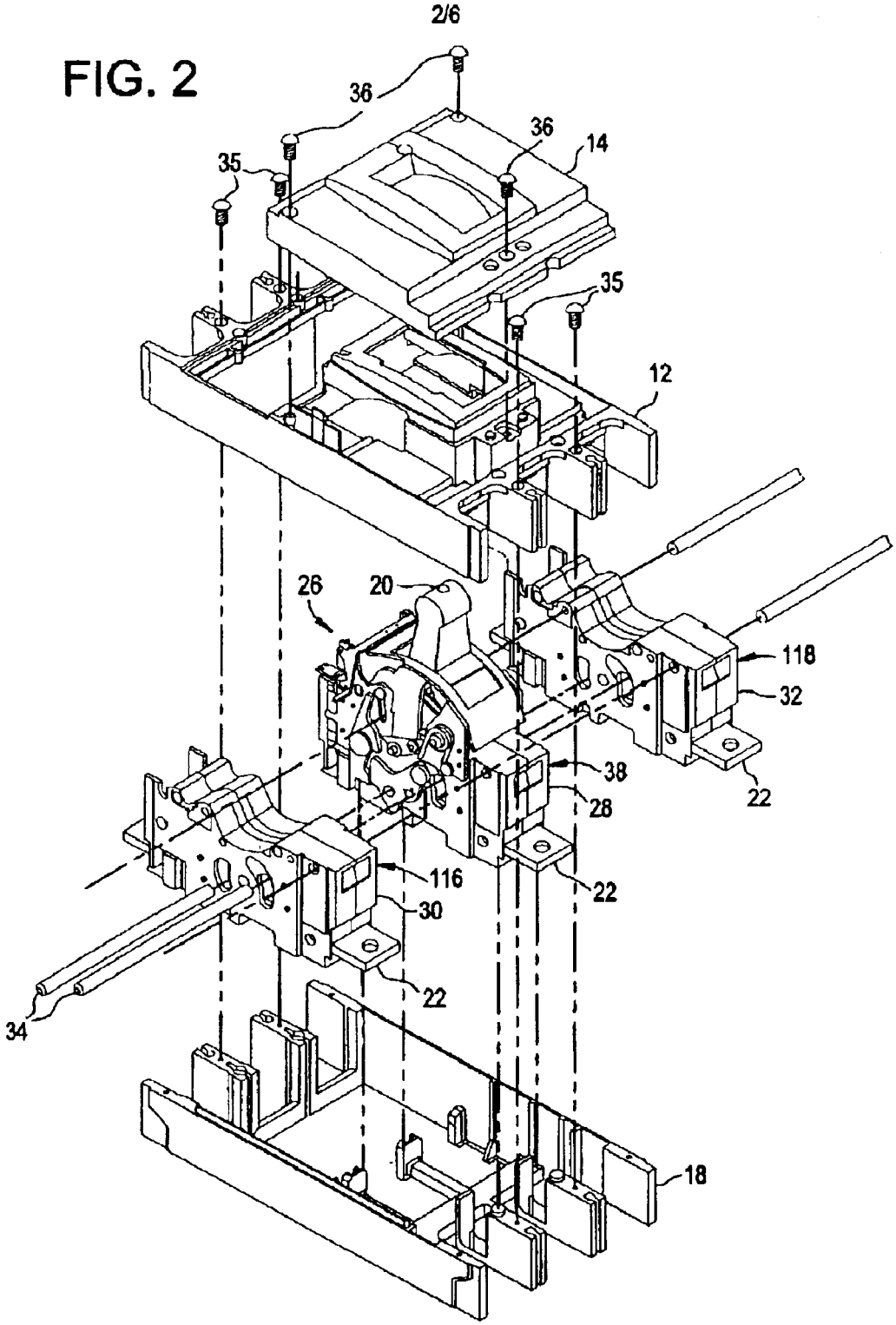
FIG. 2 is an exploded view of the circuit breaker of FIG. 1.

Referring to FIG. 2, the handle 20 is attached to a circuit breaker operating mechanism 26. The circuit breaker operating mechanism 26 is coupled with a center cassette (housing) 28 and is connected with outer cassettes (housings) 30 and 32 by drive pin 34. The cassettes 28, 30, and 32 along with the circuit breaker operating mechanism 26 are assembled into base 18 and retained therein by the mid-cover 12. The mid-cover 12 is connected to the base 18 by any convenient means, such as screws 35, snap-fit (not shown) or adhesive bonding (not shown). A cover 14 is attached to the mid-cover 12 by screws 36.

Figure 3:
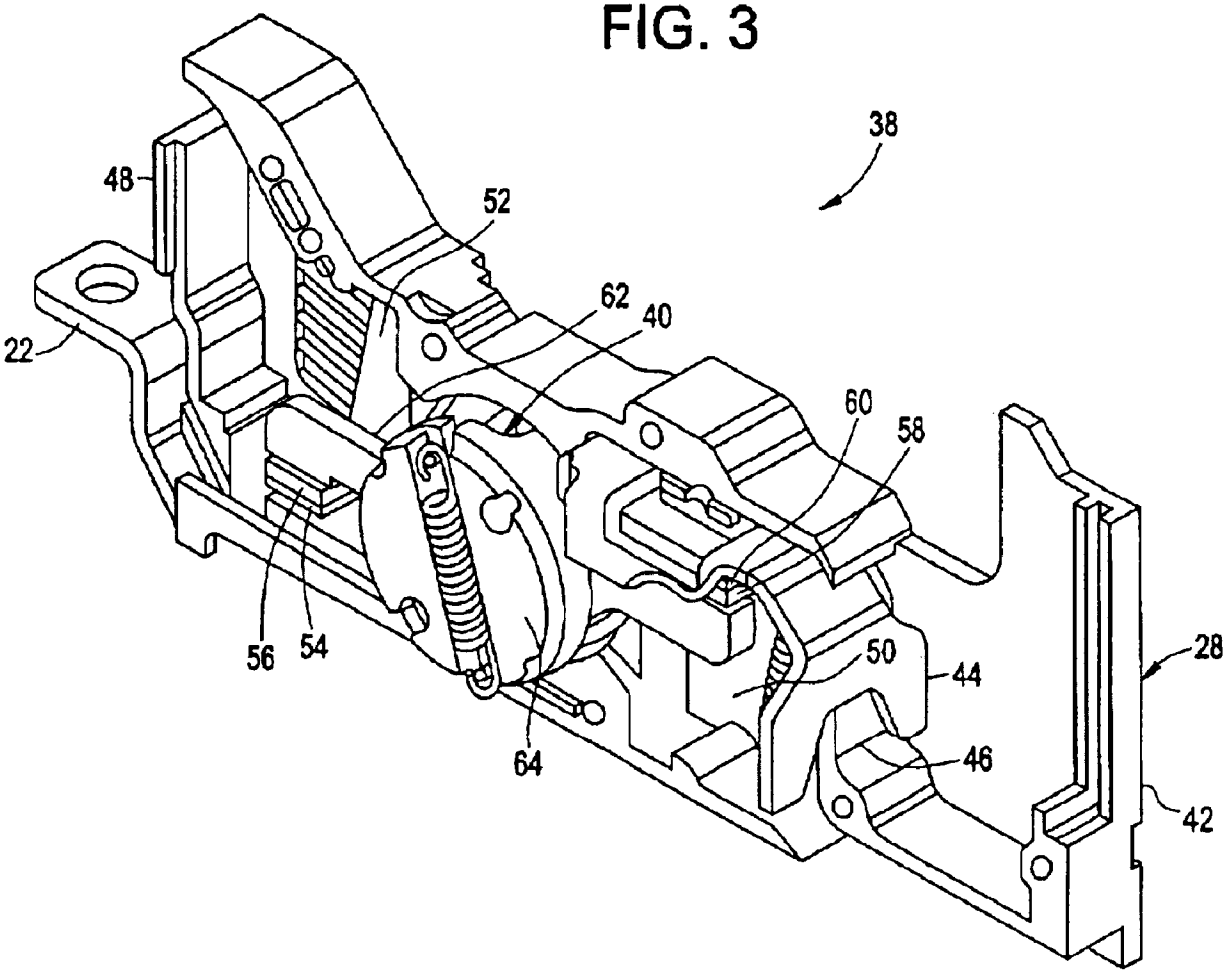
FIG. 3 is a perspective view of a circuit breaker cassette assembly.

Referring to FIG. 3, a circuit breaker cassette assembly 38 is shown and comprises a rotary contact assembly, shown generally at 40, in a first electrically-insulative cassette half-piece 42 of center cassette 28 intermediate a line-side contact strap 22, and a load-side contact strap 44. Line-side contact strap 22 is electrically connectable to line-side wiring (not shown) in an electrical distribution circuit, and load-side contact strap 44 is electrically connectable to load-side wiring (not shown) via a lug (not shown) or a mechanism such as a bimetallic element or current sensor (not shown). Electrically insulative shields 46, 48 separate load-side contact strap 44 and line-side contact strap 22 from the associated arc chute assemblies 50, 52, respectively. Although only a single circuit breaker cassette assembly 38 is shown, a separate circuit breaker cassette assembly 38 is employed for each pole of a multi-pole circuit breaker and operated in a manner similar to that of circuit breaker cassette assembly 38.

Electrical transport through rotary contact assembly 40 of circuit breaker cassette assembly 38 occurs from line-side contact strap 22 to an associated first fixed contact 54, through first and second movable contacts 56, 58 secured to the ends of a movable contact arm, shown generally at 62, and to an associated second fixed contact 60 on load-side contact strap 44. Movable contact arm 62 is pivotally arranged between two halves of a rotor 64 and moves in conjunction with rotor 64 upon manual articulation of rotor 64. Rotor 64 is rotatably positioned on a rotor pivot axle 102 (shown below with reference to FIG. 5), the ends of which are supported by inner parallel walls of first electrically-insulative cassette half-piece 42.

The arc chute assemblies 50, 52 are positioned in the first electrically insulative cassette half piece 42 adjacent the respective pairs of first fixed and first moveable contacts 54, 56 and second fixed and second moveable contacts 60, 58. The first and second movable contacts 56, 58 and moveable contact arm 62 move through a passageway provided by the arc chute assemblies 50, 52 in order to engage and disengage from the respective first and second fixed contacts 54, 60. Each arc chute assembly 50, 52 is adapted to interrupt and extinguish the arc which forms when the circuit breaker 10 is tripped and the first and second moveable contacts 56, 58 are suddenly separated from the first and second fixed contacts 54, 60.

Referring back to FIG. 2, it is understood circuit breaker cassette assemblies 116, 118, that include cassettes 30, 32, respectively, are similarly constructed to circuit breaker cassette assembly 38 including rotary contact assembly 40 described herein.

Figure 4:
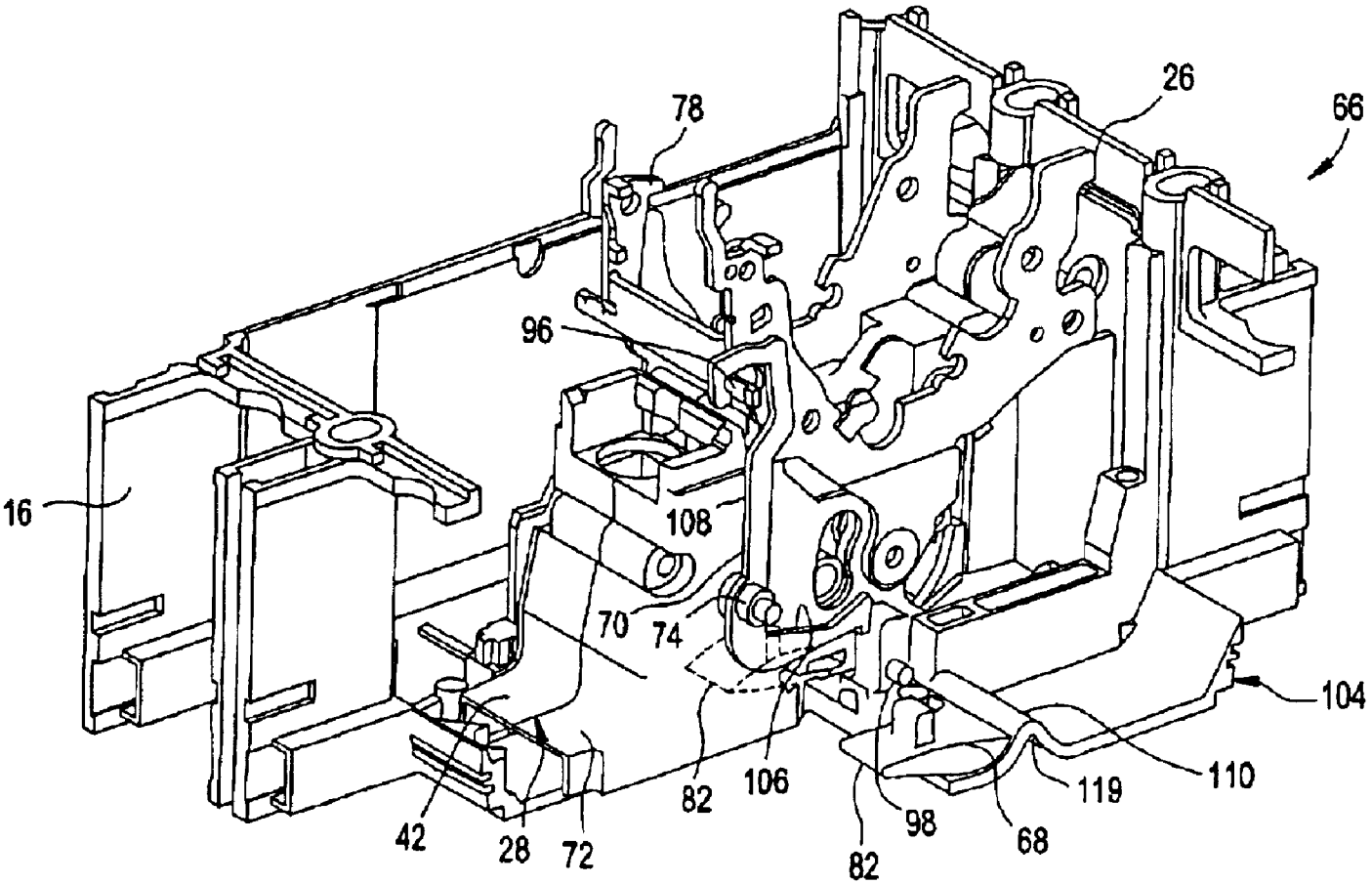
FIG. 4 is a perspective view of the pressure sensitive trip mechanism, of the present invention, mounted onto a cassette.

Referring to FIG. 4, a pressure sensitive trip mechanism (unit) 66 is shown mounted onto a second electrically cassette insulative half-piece 72. Center cassette 28 is formed by the mating of electrically insulative cassette half-piece 72 with first electrically insualtive cassette half-piece 42. The pressure sensitive trip mechanism 66 comprises a trip bar 68 and a trip lever 70. Trip bar 68 has a base section 80. Trip lever 70 comprises a first section 106 and a second section 108 and is rotatably mounted about a pivot 74 located on an exterior surface of center cassette 28. First section 106 of trip lever 70 extends in a generally horizontal direction adjacent the second electrically insulative cassette half-piece 72 towards the center of the center cassette 28. Second section 108 of trip lever 70 extends in a generally vertical direction adjacent to the second electrically insulative cassette half-piece 72. A circuit breaker operating mechanism 26 includes a latch assembly 78. Latch assembly 78 is actuatable by trip lever 70. The trip lever 70 is actuatable by the trip bar 68. The trip bar 68 is preferably molded of a high strength, high temperature thermoplastic. The trip lever 70 is preferably stamped from steel, but can also be molded of high strength plastic.

A bearing member 104 having a bearing surface 110 is preferably integrally molded into the base 18 of the circuit breaker 10 and has generally a flattened and thin structure. Bearing surface 110 is positioned proximate to the bottom surface of base section 80 of the trip bar 68 and is molded and shaped to support the trip bar 68. A bend 119 is formed proximate to the base section 80. Bearing member 104 provides structural support to the trip bar 68 when the trip bar 68 is subjected to the high pressure forces of the arc gases.

Figure 5:
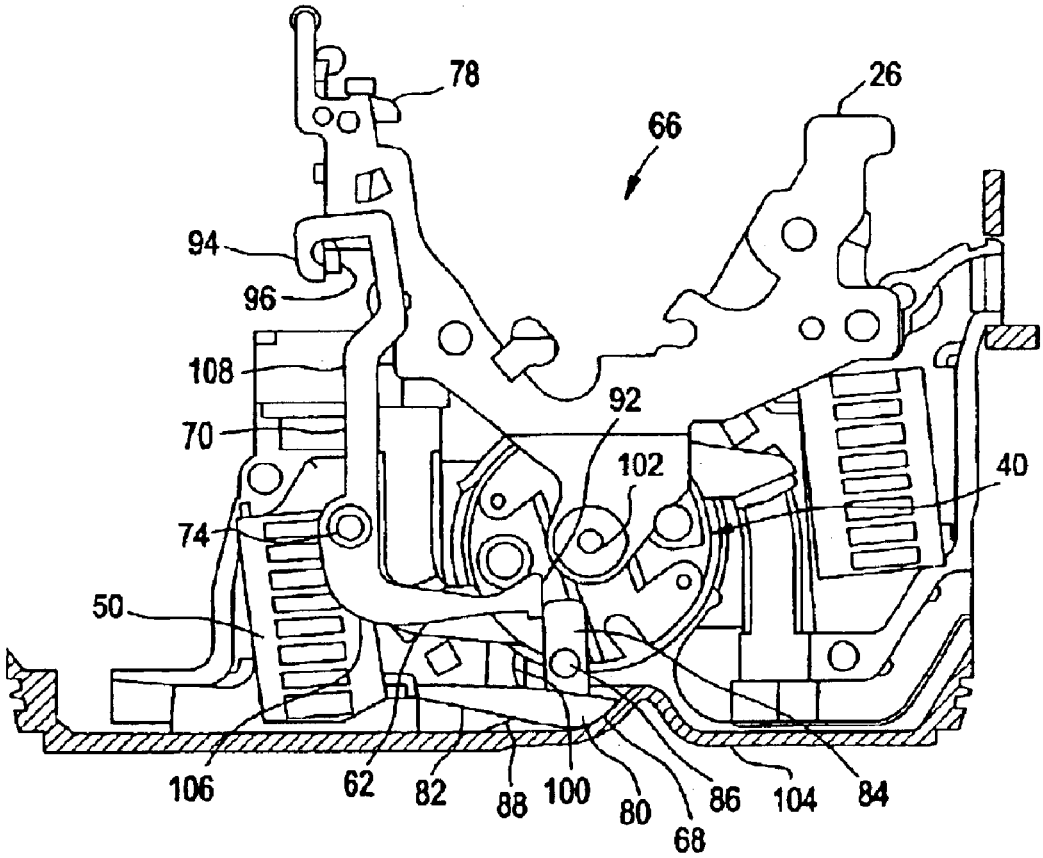
FIG. 5 is a side view of the trip bar and trip lever of the present invention, relative to a rotary contact assembly, showing the contacts in a tripped position.

Referring to FIG. 5, the pressure sensitive trip mechanism 66 will be described in further detail. The pressure sensitive trip mechanism 66 is shown as it would be positioned relative to contact arm 62 of the rotary contact assembly 40. Rotary contact assembly 40 is shown in an "off" position.

Base section 80 of trip bar 68 comprises a at least one extension (lever) 82 extending from the base section 80 and a protrusion 84 extending outward, preferably perpendicularly, from base section 80. Trip bar 68 is rotatably mounted about a pivot 86 located on the exterior surface of the second electrically insulative cassette half-piece 72 (FIG. 2). Preferably, pivot 86 is a first pivot pin (not shown) and most preferably, first pivot pin is made of metal. Pivot 86 is located on protrusion 84 and arranged for insertion into a corresponding opening (not shown) located within the exterior surface of the second electrically insulative cassette half-piece 72. The extension 8Z of trip bar 68 is inserted through a corresponding opening 88 located generally in the lower section of the center cassette 28 (FIG. 1). Opening 88 is located proximate to the arc chute 50. Thus, extension 82, when inserted inside the center cassette 28, is in gaseous communication with the arc chute 50. Preferably, base section 80 is generally flat and elongated in order to accommodate positioning proximate to cassettes 28, 30, 32.

Trip lever 70 is rotatably mounted about a pivot 74 located on the exterior surface of the second electrically insulative cassette half-piece 72 (FIG. 2). Trip lever 70 includes a free end 92 of first section 106. Free end 92 is proximate to protrusion 84. Trip lever 70 also includes a free end 94. Free end 94 is generally U-shaped so that movement of trip lever 70 in the clockwise direction moves trip arm 96 in a direction to unlatch latching mechanism 78.

For a multi-pole circuit breaker, each cassette 28, 30, 32 would have corresponding openings 88 located proximate to the respective arc chutes 50 in order that the extensions 82 (shown in phantom and solid lines in FIG. 4) extending from the base section 80 of trip bar 68 may be inserted through all cassettes being utilized.

Referring back to FIGS. 3, 4 and 5, the movement of the pressure sensitive trip mechanism 66 will now be detailed.

Under high-level short circuit or overcurrent faults, the contact arm 62 is opened due to the magnetic forces at the fixed and moveable contacts 54, 56, 58, 60. As the contact arm 62 is opened and the moveable contacts 56, 58 are separated from the fixed contacts 54, 60 a plasma arc is formed between the fixed and moveable contacts 54, 56, 58, 60. This arc generates arc gases of relatively high pressure within the center cassette 28.

Generally, the level of pressure created in the center cassette 28 is proportional to the current and voltage levels of the fault. Once the pressure inside the arc chute 50 reaches a predetermined level that is consistent with the desired overcurrent or short circuit overcurrent level for which a trip of the circuit breaker 10 is desired, the extension 82 of trip bar 68 will rotate counterclockwise about pivot 86 in response to the force exerted on it by the increased pressure. The rotation of trip bar 68 will cause radial protrusion 84 to make contact with, and apply a force against, free end 92 of trip lever 70. The trip lever 70, in reaction to the movement of trip bar 68, will rotate clockwise about pivot 74. The free end 94 of trip lever 70 then makes contact with the trip arm 96 of the latch assembly 78. Latch assembly 78 unlatches the circuit breaker operating mechanism 26 causing all phases of the circuit breaker 10 to trip in response to the short circuit or overcurrent fault condition.

Incidentally, it will be appreciated that the pressure sensitive trip mechanism 66 can be arranged for use in a circuit breaker having a plurality of cassettes 28, 30, 32 as shown in FIG. 1. Each pole of a particular circuit breaker utilizes one extension 82 located along trip bar 68. Each respective extension 82 extending from the trip bar 68 will react to the pressure created within the corresponding cassette 28, 30, 32. In this way, the trip lever 70 which is located proximate to the extension 82 of the trip bar 68, as well as the trip bar 68, responds to a fault condition in any pole of the circuit breaker 10. When a high level short circuit or overcurrent fault occurs, the most loaded pole will trip due to the pressure increase in the respective cassette 28, 30, 32. In this way, each pole employs the trip bar 68 and the trip lever 70. A trip of one pole moves the latch assembly 78 thereby unlatching the circuit breaker operating mechanism 26. Once the circuit breaker operating mechanism 26 is unlatched, all contacts associated with the poles of the circuit breaker are opened by the circuit breaker operating mechanism 26 and the flow of electrical current through the circuit breaker is stopped.

Referring to FIG. 5, in a further exemplary embodiment of the present invention, a trip finger 100 is employed with the trip bar 68 and trip lever 70 to mechanically trip the circuit breaker 10. In this embodiment of the present invention, at least one trip finger 100 protrudes outward from the trip bar 68, preferably in the same general direction as the protrusion 84. Trip finger 100 is located proximate to contact arm 62 on the load side of the cassette assembly 38.

Referring to FIGS. 2, 3 and 5, the manner in which the trip finger 100 operates relative to the rotary contact assembly 40 in order to mechanically trip the circuit breaker 10 will be detailed.

Under high-level short circuit or overcurrent faults, the contact arm 62 is opened due to the magnetic forces at the fixed and moveable contacts 54, 56, 58, 60. As the contact arm 62 is opened and the moveable contacts 54, 60 are separated from the fixed contacts 56, 58, the contact arm 62 rotates counterclockwise about rotor axle pivot 102. The rotation of the contact arm 62 causes the contact arm 62 to make contact with trip finger 100 located on trip bar 68. Trip bar 68 will then rotate counterclockwise about pivot 86 in response to the force exerted on the trip finger 100. The rotation of trip bar 68 will cause protrusion 84 to make contact with, and apply force against, free end 92 of trip lever 70. The trip lever 70, in reaction to the movement of trip bar 68, will rotate clockwise about pivot 74. The free end 94 of trip lever 70 then makes contact with the trip arm 96 of the latch assembly 78. Latch assembly 78 unlatches the circuit breaker operating mechanism 26 causing all phases of the circuit breaker to trip in response to the short circuit or overcurrent fault condition.

Figure 6:
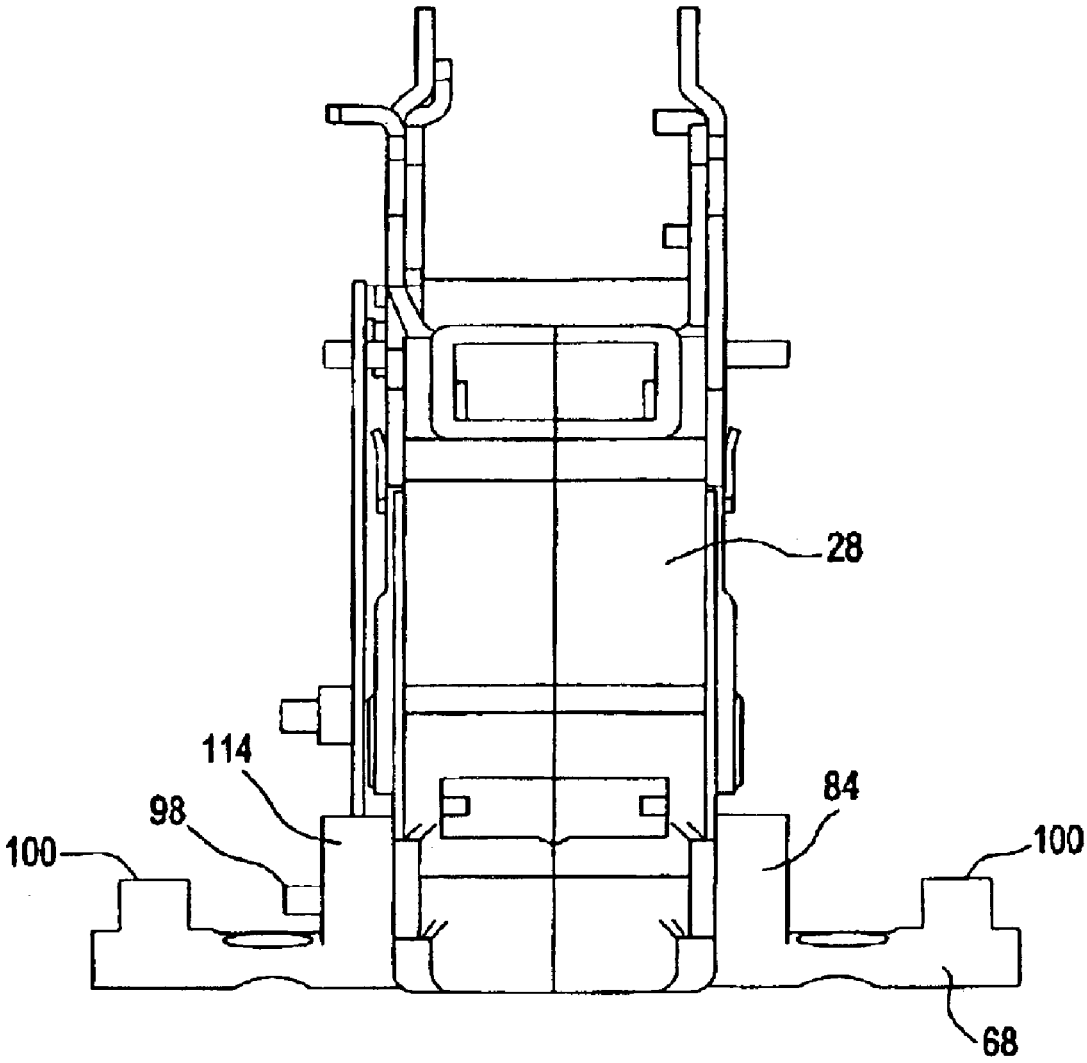
FIG. 6 is a front end view of a center cassette and the trip bar of the present invention.

Referring to FIG. 6, the line-side front end view of the center cassette 28 relative to the trip bar 68 is shown. It will be appreciated that in a multi-pole circuit breaker, the number of trip fingers 100 utilized on the trip bar 68 will correspond to the number of poles for a particular circuit breaker. Each pole or phase of the circuit breaker utilizes one trip finger 100 located along trip bar 68. For example, and referring to the three pole circuit breaker 10 shown in FIG. 2, trip bar 68 would have three extensions 82 and three trip fingers 100. In this way, each contact arm 62 (FIG. 3) employed in a multi-pole circuit breaker individually acts upon the respective trip finger 100 located on the base section 86 of trip bar 68. Each respective trip finger 100 will be located proximate to the corresponding contact arm 62. When a high level short circuit or overcurrent fault occurs, the most loaded pole will trip causing the respective contact arm 62 to blow open and make contact with the respective trip finger 100. In this way, each pole employs the base section 80 (FIG. 5) and protrusion 84 of the trip bar 68 as well as the trip lever 70 (FIG. 5). A trip of one pole moves the latch assembly 78 (FIG. 5) thereby unlatching the circuit breaker operating mechanism 26 (FIG. 5). Once the circuit breaker operating mechanism 26 is unlatched, all contacts associated with the poles of the circuit breaker open and the flow of electrical current through the circuit breaker is stopped.

Referring to FIGS. 2, 3 and 5, it is further noted and within the scope of the invention that in the multi-pole circuit breaker 10, a second pivot pin 98 or the first pivot pin (not shown) may be utilized on protrusion 84 of trip bar 68 to fit into a corresponding opening (not shown) in the exterior surface of the outer cassette 30. Also, a second protrusion 114 may extend outward from base section 80 and positioned proximate the center cassette 28 and the third cassette 32. Second protrusion 114 may utilize a third pivot pin (not shown) for insertion into a corresponding opening (not shown) in the exterior surface of first electrically-insulative cassette half-piece 42 of center cassette 28. Second protrusion 114 may also utilize a fourth pivot pin (not shown) for insertion into a corresponding opening (not shown) in the exterior surface of outer cassette 32.

As described herein, the pressure sensitive trip mechanism 66 for actuating a circuit breaker operating mechanism to trip a circuit breaker includes a trip lever 70 and a trip bar 68 and is readily adaptable to a variety of circuit breakers. The pressure sensitive trip mechanism 66 provides for very fast tripping of the circuit breaker 10 in the event of a short circuit condition or an overcurrent fault condition within any one of the circuit breaker poles. Fast response time to trip the circuit breaker 10 is achieved due to the close proximity of the trip bar 68 and extensions 82 to the source of the high pressure generated within the cassettes 28, 30, 32. Thus, the pressure sensitive trip mechanism 66 will cause the circuit breaker to trip should any one phase in a multi-phase circuit breaker blow open before the trip unit (e.g. mechanical or electronic) can react and trip the circuit breaker. Fast tripping during a short circuit condition protects the fixed and movable contacts 54, 56, 58, 60 and arc chutes 50, 52 from excessive wear due to extended exposure to high arcing energy. Finally, bearing member 104 provides structural support for the trip bar 68 and ensures that the high pressure force acting on the trip bar 68 is translated into a rotational force that rotates the trip bar 68.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but the invention will include all embodiments falling within the scope of the appended claims.

What is claimed is:

1. A circuit breaker assembly comprising:

a first set of electrical contacts associated with a first pole of the circuit breaker;

a first lever;

a second set of electrical contacts associated with a second pole of the circuit breaker, the second set of electrical contacts separates in response to rotation of tic first lever; and a second lever, the first set of electrical contacts separates in response to rotation of the second lever;

wherein in response to the separation of the first set of electrical contacts, pressurized gas created by the separation of the first set of electrical contacts acts on and rotates the first lever, thereby resulting in the separation of the second set of electrical contacts;

wherein pressurized gas created by separation of the second set of electrical contacts sets on and rotates the second lever.

2. The circuit breaker assembly of claim 1, wherein the first lever is rotatably disposed at a first, housing and includes a surface in direct fluid communication with an interior of the first housing, the first set of electrical contacts being disposed in the first housing.

3. The circuit breaker assembly of claim 2, wherein the first housing includes a hole disposed therein, a portion of the first lever is disposed proximate the hole, and at least a portion of the pressurized gas created by separation of the first set of electrical contacts exits the first housing through the hole.

4. The circuit breaker assembly of claim 1, wherein an electrical contact in the first set of electrical contacts is mounted oil an arm, and the arm contacts and rotates the first lever in response to the first set of electrical contacts being separated.

5. The circuit breaker assembly of claim 1, wherein the first lever is coupled to the second lever.

6. A circuit breaker assembly comprising:

a first set of electrical contacts at a first pole of a circuit breaker;

a second set of electrical contacts at a second polo of the circuit breaker;

means for separating the second set or contacts in response to a predetermined level or pressurized gas created by separation of the first set of electrical contacts; and means for separating the first set electrical contacts in response to a predetermined level of pressurized gas created by separation of the second set of electrical contacts;

wherein the first set or electrical contacts separate in response to an electrical fault conditions at the first pole, and the second set of electrical contacts separate in response to the means for separating the second sot of contacts;

wherein the means for separating the second set of electrical contacts includes a first lever, the pressurized gas created by separation of the first set of electrical contacts acts on and rotates the first lever; and wherein the means for separating the first set of electrical contacts includes a second lever, the pressurized gas created by separation of the second set of electrical contacts acts on and rotates the second lever.

7. The circuit breaker of claim 6, wherein the second lover is rotatably disposed on a second housing, the second set of electrical contacts being disposed in the second housing.

8. The circuit breaker assembly of claim 7, wherein the second housing includes a hole disposed therein, a portion of the second lever is disposed proximate the hole, and at least a portion of the pressurized as created by separation of the second set of electrical contacts exits the second housing through the hole.

* * * * *